US009837020B2

(12) United States Patent
Knepper et al.

(10) Patent No.: US 9,837,020 B2
(45) Date of Patent: Dec. 5, 2017

(54) POWER CONTROL IN AN ORGANIC LIGHT EMITTING DIODE (OLED) DISPLAY DEVICE

(71) Applicant: Dell Products, L.P., Round Rock, TX (US)

(72) Inventors: Lawrence Edward Knepper, Leander, TX (US); Deeder M. Aurongzeb, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 181 days.

(21) Appl. No.: 14/723,686

(22) Filed: May 28, 2015

(65) Prior Publication Data

US 2016/0351118 A1 Dec. 1, 2016

(51) Int. Cl.

| | |
|---|---|
| ***G09G 3/30*** | (2006.01) |
| ***G09G 3/3233*** | (2016.01) |
| ***G09G 3/3208*** | (2016.01) |
| *G09G 5/02* | (2006.01) |

(52) U.S. Cl.

CPC ..... *G09G 3/3233* (2013.01); *G09G 3/3208* (2013.01); *G09G 5/026* (2013.01); *G09G 2300/0452* (2013.01); *G09G 2320/0295* (2013.01); *G09G 2320/0693* (2013.01); *G09G 2330/021* (2013.01); *G09G 2330/023* (2013.01); *G09G 2330/026* (2013.01); *G09G 2330/12* (2013.01); *G09G 2360/08* (2013.01); *G09G 2380/02* (2013.01)

(58) Field of Classification Search

None

See application file for complete search history.

(56) References Cited

U.S. PATENT DOCUMENTS

| | | | | |
|---|---|---|---|---|
| 2008/0266214 | A1* | 10/2008 | Naugler | G09G 3/3225 345/76 |
| 2009/0160742 | A1* | 6/2009 | Mizukoshi | G09G 3/3233 345/77 |
| 2010/0331057 | A1* | 12/2010 | Tanaka | H04W 52/0264 455/574 |
| 2012/0019509 | A1* | 1/2012 | Wei | G09G 3/344 345/213 |
| 2014/0043316 | A1* | 2/2014 | Chaji | G09G 3/3233 345/212 |

(Continued)

OTHER PUBLICATIONS

Merriam-Webster Dictiionary definition of "calibrate", www.merriam-webster.com/dictionary/calibrate, 2017, p. 1.*

(Continued)

*Primary Examiner* — Ilana Spar
*Assistant Examiner* — Kirk Hermann
(74) *Attorney, Agent, or Firm* — Norton Rose Fulbright US LLP

(57) ABSTRACT

Embodiments of systems and methods for power control in an Organic Light Emitting Diode (OLED) display device are described. In an embodiment, a method includes monitoring a level of current draw from an Organic Light Emitting Diode (OLED) display device. The method may also include comparing the level of current draw to a threshold value. Additionally, a method may include throttling system power consumption in response to the level of current draw exceeding the threshold value.

20 Claims, 6 Drawing Sheets

(56) References Cited

U.S. PATENT DOCUMENTS

| | | | | |
|---|---|---|---|---|
| 2014/0063074 | A1* | 3/2014 | Drzaic | G09G 3/30 345/690 |
| 2016/0128144 | A1* | 5/2016 | Tikkanen | H05B 33/0815 315/301 |

OTHER PUBLICATIONS

Merriam-Webster Dictionary definition of "throttle", www.merriam-webster.com/dictionary/throttle, 2017, p. 1.*

* cited by examiner

POWER CONTROL IN AN ORGANIC LIGHT EMITTING DIODE (OLED) DISPLAY DEVICE

FIELD

This disclosure relates generally to display devices for information handling systems, and more specifically, to power control in an Organic Light Emitting Diode (OLED) display device.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An information handling system is often coupled with a display device for communication of information to a user. Some display devices are Liquid Crystal Display (LCD) devices. Some LCD devices are backlit by an array of Light Emitting Diode (LED) devices which typically emit white or close to white light. The typical LCD device may open channels for light to pass through a colored filter channel for creating images on the display. Unlike typical LCD devices, and OLED display may include an array of OLED devices which are inherently configured to display a color. Typically the OLED devices are arranged in sets of four devices, including blue LEDs, green LEDs, and red LEDs, where such an arrangement constitutes pixels. For example, a typical pentile arrangement has more than twice as many green pixels as red or blue, partly because the green OLEDs are smaller and partly because green degrades faster. In order to change the color of the pixel, each of the LED devices comprising the pixel are selectively turned on to a specified intensity level.

Typically an all-white display requires the maximum current draw, because each of the LEDs is turned on to a maximum intensity level. The maximum intensity level may be the devices native maximum, or a maximum as set by a threshold value. In an OLED display, the power consumed by the display increases in proportion to the number of active pixels and the intensity of each pixel. This is characterized by an "On-Pixel Ratio" (OPR) and the power consumed by the display is generally linear in relation to the OPR.

SUMMARY

Embodiments of systems and methods for power control in an Organic Light Emitting Diode (OLED) display device are described. In an embodiment, a method includes monitoring a level of current draw from an Organic Light Emitting Diode (OLED) display device. The method may also include comparing the level of current draw to a threshold value. Additionally, a method may include throttling system power consumption in response to the level of current draw exceeding the threshold value.

In an embodiment, the method may further include calibrating the threshold value upon system initialization. In such an embodiment, calibrating the threshold value may further include causing the OLED display device to display white on each pixel. Additionally, calibrating the threshold value may include measuring the level of current draw while the OLED display device is displaying white on each pixel. Calibrating the threshold value may also include setting a scaling function to set thresholds at predetermined ratios of the full power when the OLED display device is displaying white on each pixel.

In an embodiment, the method may include measuring a current value at a current sensor disposed between a power source and an OLED matrix. The method may also include measuring a time interval in which the level of current draw exceeds the threshold. In such an embodiment, the method may include determining whether the level of current draw has exceeded the threshold during the time interval.

In an embodiment, the method may include throttling the system power further comprises causing the system power control to enter a power-save mode. Throttling the system power may include sub-sampling one or more OLEDs in the OLED display device.

An embodiment, of a system may include a current sensor device configured to monitor a level of current draw from an Organic Light Emitting Diode (OLED) display device. The system may also include a controller coupled to the current sensor device, the controller configured to compare the level of current draw to a threshold value, and throttle system power consumption in response to the level of current draw exceeding the threshold value.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity, and have not necessarily been drawn to scale.

DETAILED DESCRIPTION

Embodiments of methods and systems for power control in an OLED display device are described. In the described embodiments, the methods and systems provide detect conditions in which one or more power reduction modes can be implemented, and then reduces either the power supplied to the OLED device, or reduces the power consumed by the system.

Figure 1A:
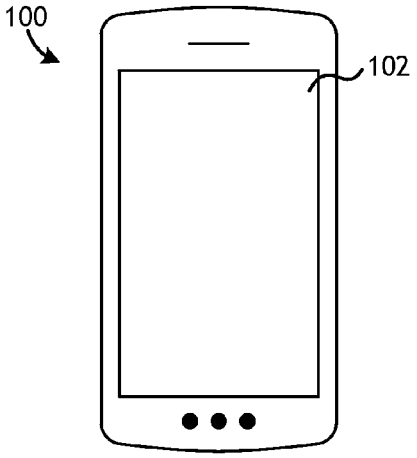
FIG. 1A is a schematic diagram illustrating one embodiment of an OLED display device.

FIG. 1A is a schematic diagram illustrating one embodiment of a rigid screen OLED display device 100. In an embodiment, the OLED display device 100 may include a screen 102 for displaying information to a user. The screen 102 may be comprised of pixels, each pixel containing an arrangement of OLED devices configured to generate light at a controlled intensity and designated color. An example of a pixel and arrangement of OLED devices is described below with respect to FIG. 5. Examples of rigid screen OLED display devices 100 include, but are not limited to, Personal Data Assistant (PDA) devices, cell phones, smartphones, tablet computers, laptop computers, computer monitor devices, television sets, kiosk devices, digital or smart wristwatches, etc.

Figure 1B:
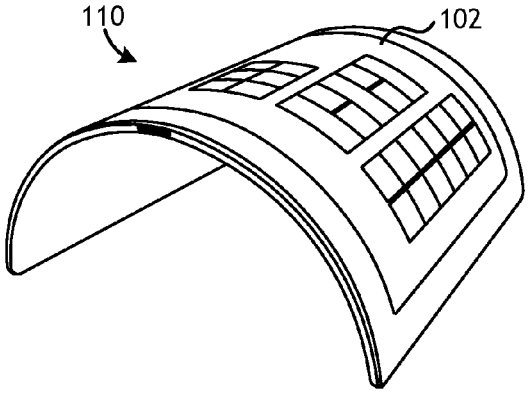
FIG. 1B is a schematic diagram illustrating another embodiment of an OLED display device.

FIG. 1B is a schematic diagram illustrating another embodiment of a flexible screen OLED display device 110. In an embodiment, the flexible screen OLED display device 110 may include a screen 102 for displaying information to a user. In certain embodiments, the OLED devices may be arranged or formed on a flexible substrate. Examples of flexible screen OLED display devices 110 include, but are not limited to, digital reading devices, digital or smart wristwatches, curved television screens, flexible smartphone devices, expandable or deployable interface screens, flexible digital banner devices, etc. One of ordinary skill will recognize that the present embodiments may be used in association with a wide variety of flexible screen OLED display devices 110.

Figure 1C:
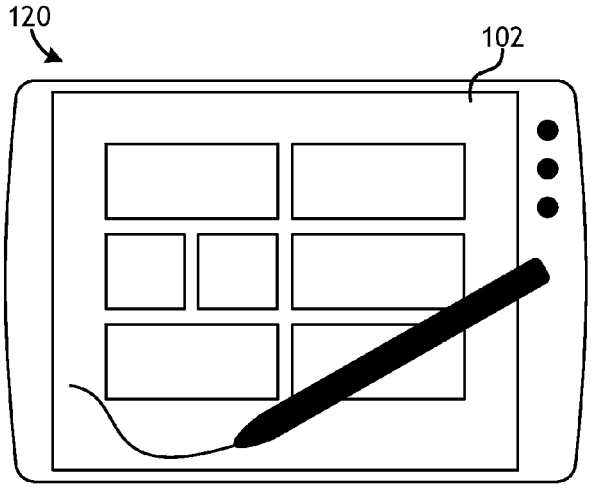
FIG. 1C is a schematic diagram illustrating another embodiment of an OLED display device.

FIG. 1C is a schematic diagram illustrating another embodiment of a touchscreen OLED display device 120. The touchscreen OLED display device 120 may also include a screen 102 comprised of pixels of OLED devices. In one embodiment, touch or pressure feedback systems may be employed in associated with the screen 102 to provide user inputs to the touchscreen OLED display device 120. Embodiments of touchscreen OLED display devices 120 may include smartphones, tablet computers, laptop computers, desktop computers, televisions, display screens, smart wristwatches, etc.

In some embodiments, the screen 102 may display information for an information handling system. In another embodiment, an information handling system may operate hardware modules, or run firmware and/or software for controlling the screen 102.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 2:
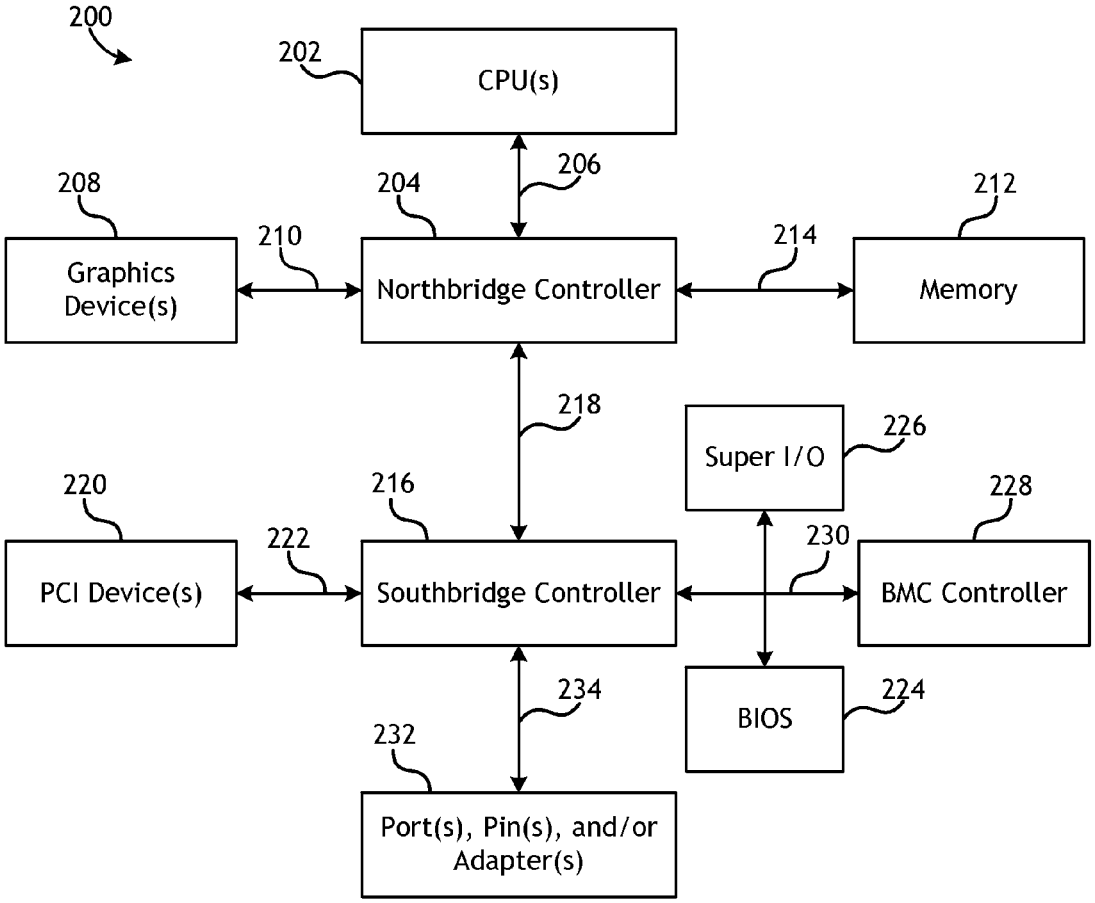
FIG. 2 is a schematic block diagram illustrating one embodiment of an Information Handling System (IHS) configured for power control in an OLED display device.

FIG. 2 is a schematic block diagram illustrating one embodiment of an IHS 200 which may be programmed according to embodiments of a display device of FIGS. 1A-C. As shown, IHS 200 includes one or more CPUs 202. In various embodiments, IHS 200 may be a single-processor system including one CPU 202, or a multi-processor system including two or more CPUs 202 (e.g., two, four, eight, or any other suitable number). CPU(s) 202 may include any processor capable of executing program instructions. For example, in various embodiments, CPU(s) 202 may be processors capable of implementing any of a variety of instruction set architectures (ISAs), such as the x86, POWERPC®, ARM®, SPARC®, or MIPS® ISAs, or any other suitable ISA. In multi-processor systems, each of CPU(s) 202 may commonly, but not necessarily, implement the same ISA.

CPU(s) 202 are coupled to northbridge controller or chipset 204 via front-side bus 206. In most embodiments, the front-side bus 206 will include multiple data links arranged in a set or bus configuration. Northbridge controller 204 may be configured to coordinate I/O traffic between CPU(s) 202 and other components. For example, in this particular implementation, northbridge controller 204 is coupled to graphics device(s) 208 (e.g., one or more video cards or adaptors, etc.) via graphics bus 210 (e.g., an Accelerated Graphics Port or AGP bus, a Peripheral Component Interconnect or PCI bus, etc.). Northbridge controller 204 is also coupled to system memory 212 via memory bus 214. Memory 212 may be configured to store program instructions and/or data accessible by CPU(s) 202. In various embodiments, memory 212 may be implemented using any suitable memory technology, such as static RAM (SRAM), synchronous dynamic RAM (SDRAM), nonvolatile/Flash-type memory, or any other type of memory.

Northbridge controller 204 is coupled to southbridge controller or chipset 216 via internal bus 218. Generally, southbridge controller 216 may be configured to handle various of IHS 200's I/O operations, and it may provide interfaces such as, for instance, Universal Serial Bus (USB), audio, serial, parallel, Ethernet, etc., via port(s), pin(s), and/or adapter(s) 232 over bus 234. For example, southbridge controller 216 may be configured to allow data to be exchanged between IHS 200 and other devices, such as other IHSs attached to a network. In various embodiments, southbridge controller 216 may support communication via wired or wireless general data networks, such as any suitable type of Ethernet network, for example; via telecommunications/telephony networks such as analog voice networks or digital fiber communications networks; via storage area networks such as Fiber Channel SANs; or via any other suitable type of network and/or protocol.

Southbridge controller 216 may also enable connection to one or more keyboards, keypads, touch screens, scanning devices, voice or optical recognition devices, or any other devices suitable for entering or retrieving data. Multiple I/O devices may be present in IHS 200. In some embodiments, I/O devices may be separate from IHS 200 and may interact with IHS 200 through a wired or wireless connection. As shown, southbridge controller 216 is further coupled to one or more PCI devices 220 (e.g., modems, network cards, sound cards, video cards, etc.) via PCI bus 222. Southbridge controller 216 is also coupled to Basic I/O System (BIOS) 224, Super I/O Controller 226, and Baseboard Management Controller (BMC) 228 via Low Pin Count (LPC) bus 230.

BIOS 224 includes non-volatile memory having program instructions stored thereon. Those instructions may be used by CPU(s) 202 to initialize and test other hardware components and/or to load an Operating System (OS) onto IHS 200. As such, BIOS 224 may include a firmware interface that allows CPU(s) 202 to load and execute certain firmware, as described in more detail below. In some cases, such firmware may include program code that is compatible with the Unified Extensible Firmware Interface (UEFI) specification, although other types of firmware may be used.

BMC controller 228 may include non-volatile memory having program instructions stored thereon that are usable by CPU(s) 202 to enable remote management of IHS 200. For example, BMC controller 228 may enable a user to discover, configure, and manage BMC controller 228, setup configuration options, resolve and administer hardware or software problems, etc. Additionally or alternatively, BMC controller 228 may include one or more firmware volumes, each volume having one or more firmware files used by the BIOS' firmware interface to initialize and test components of IHS 200.

Super I/O Controller 226 combines interfaces for a variety of lower bandwidth or low data rate devices. Those devices may include, for example, floppy disks, parallel ports, keyboard and mouse, temperature sensor and fan speed monitoring, etc.

In some cases, IHS 200 may be configured to access different types of computer-accessible media separate from memory 212. Generally speaking, a computer-accessible medium may include any tangible, non-transitory storage media or memory media such as electronic, magnetic, or optical media—e.g., magnetic disk, a hard drive, a CD/DVD-ROM, a Flash memory, etc. coupled to IHS 200 via northbridge controller 204 and/or southbridge controller 216.

The terms "tangible" and "non-transitory," as used herein, are intended to describe a computer-readable storage medium (or "memory") excluding propagating electromagnetic signals; but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

A person of ordinary skill in the art will appreciate that IHS 200 is merely illustrative and is not intended to limit the scope of the disclosure described herein. In particular, any computer system and/or device may include any combination of hardware or software capable of performing certain operations described herein. In addition, the operations performed by the illustrated components may, in some embodiments, be performed by fewer components or distributed across additional components. Similarly, in other embodiments, the operations of some of the illustrated components may not be performed and/or other additional operations may be available.

For example, in some implementations, northbridge controller 204 may be combined with southbridge controller 216, and/or be at least partially incorporated into CPU(s) 202. In other implementations, one or more of the devices or components shown in FIG. 2 may be absent, or one or more other components may be added. Accordingly, systems and methods described herein may be implemented or executed with other computer system configurations. In some cases, various elements shown in FIG. 2 may be mounted on a motherboard and protected by a chassis or the like.

Figure 3:
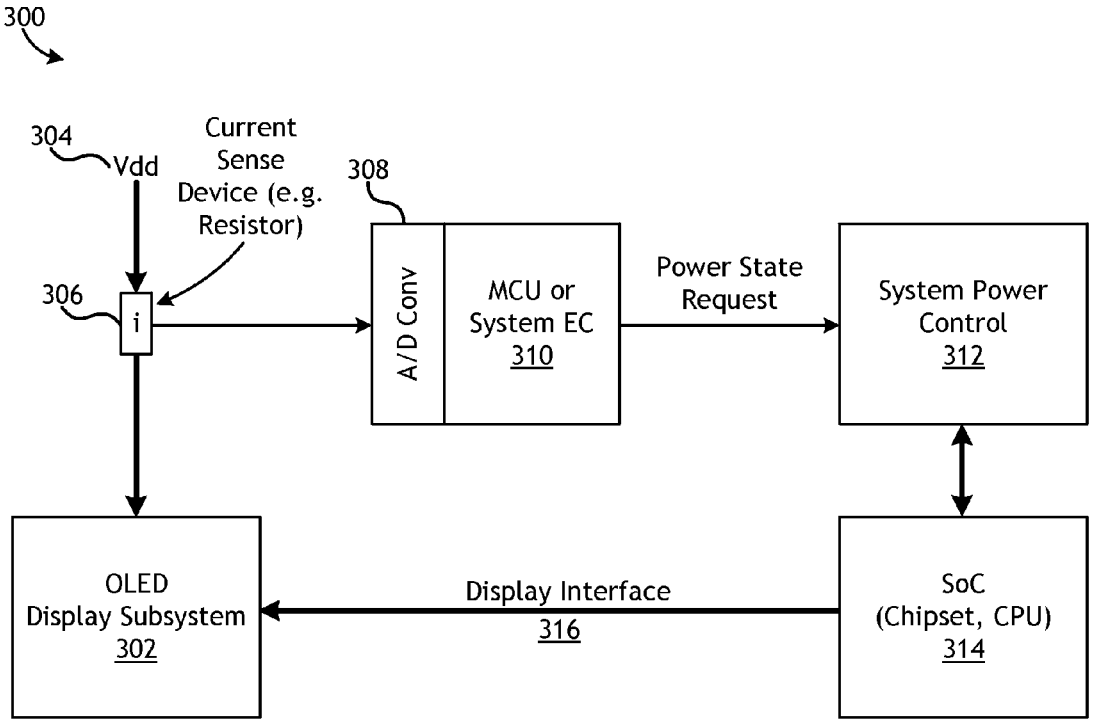
FIG. 3 is a schematic block diagram illustrating one embodiment of an apparatus for power control in an OLED display device.
Figure 5:
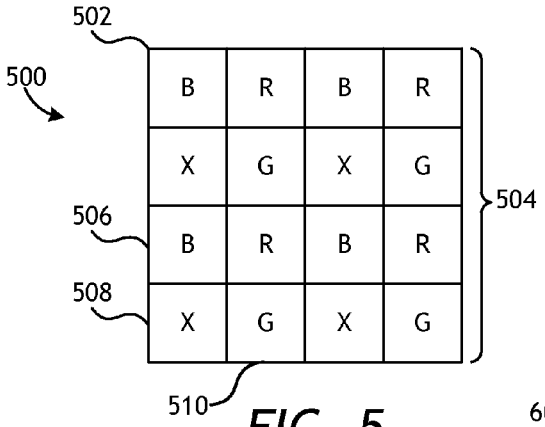
FIG. 5 is a schematic diagram illustrating one embodiment of an OLED display device.

FIG. 3 is a schematic block diagram illustrating one embodiment of an apparatus 300 for power control in an OLED display device. In an embodiment, the apparatus 300 includes an OLED display subsystem 302. The OLED display subsystem 302 may include a display matrix comprised of pixels of OLED devices as illustrated in FIG. 5. In an embodiment, the OLED display subsystem 302 may also include row and column drivers, and other peripheral components for control and optimization of the display matrix. In an embodiment, the OPR of the OLED display subsystem 302 may have a linear relationship to the current drawn by the OLED display subsystem from a power source 304, such as Vdd.

In an embodiment, the current draw may be detected by a current sense device 306. An example of a current sense device may include a resistor, or group of resistors electrically positioned between the power source 304 and the OLED display subsystem 302. The current sensed by the current sense device 306 may be communicated to a Micro-Controller Unit (MCU) or system Embedded Controller (EC) unit 310 via an Analog to Digital (A/D) converter 308. In an embodiment, the controller may be an EC which is modified to run updated firmware to carry out certain functions of the present embodiments. Alternatively, the controller 310 may be a dedicated MCU added to the system for control and execution of operations associated with the present embodiments. Examples of functions that may be carried out by the controller 310 are described below with relation to FIGS. 4 and 9.

In an embodiment, the system power controller 312 may be configured to reduce voltages and frequency of power supplied to the System on Chip (SoC) or CPU 314 in response to a power state request supplied by the controller 310. In another embodiment, the system power controller may communicate a request to an operating system to reduce power in an Advanced Configuration and Power Interface (ACPI) driver in the BIOS 224, or the like. In such an embodiment, just enough power may be supplied to maintain system register states and to ensure integrity of data in memory, but the system does not necessarily need to be functional beyond that point.

In an embodiment, the SoC or CPU 314 may monitor user inputs to the device to determine whether an interrupt should be generated to wake the system and to process the user's request. In one embodiment, the interrupt may be an operating system interrupt, or the like. In addition, the SoC or CPU 314 may implement sub-sampling of pixels in the OLED display subsystem 302 as described in relation to FIGS. 5-8. The SoC or CPU 314 may communicate sub-sampling commands to the OLED display subsystem 302 via a display interface 316. In an embodiment, the display interface 316 may include the physical components and drivers, including as embodied in a Graphical Processing Unit (GPU), for controlling the OLED display device 302.

Figure 4:
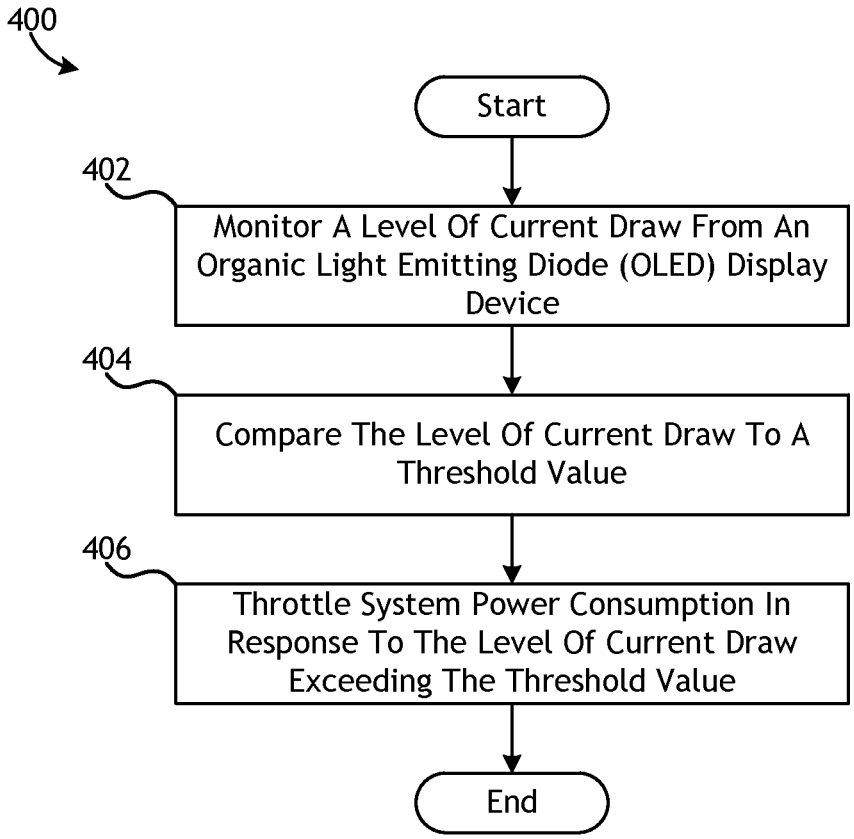
FIG. 4 is a schematic flowchart diagram illustrating one embodiment of a method for power control in an OLED display device.

FIG. 4 is a schematic flowchart diagram illustrating one embodiment of a method 400 for power control in an OLED display device. In an embodiment, the method 400 may include monitoring 402 a level of current draw from an Organic Light Emitting Diode (OLED) display device. The method 400 may also include comparing 404 the level of current draw to a threshold value. Additionally, the method 400 may include throttling 406 system power consumption in response to the level of current draw exceeding the threshold value. Additional features and embodiments of the method 400 are described below with relation to FIGS. 5-9.

It should be understood that various operations described herein may be implemented in software executed by logic or processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

FIG. 5 is a schematic diagram illustrating one embodiment of an OLED display device. In the embodiment of FIG. 5, a portion of a display matrix 500 is described. The display matrix 500 may be arranged into pixels 502, each pixel being comprised of four OLED devices 504, including a blue OLED device 506, a green OLED device 510, and two red OLED devices 508. The embodiment of FIG. 5 illustrates four pixels 502, which is comprised of sixteen (16) OLED devices 504.

Figure 6:
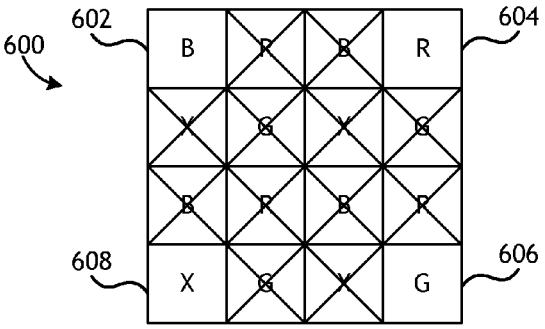
FIG. 6 is a conceptual diagram illustrating one embodiment of a method for power control in an OLED display device.
Figure 7:
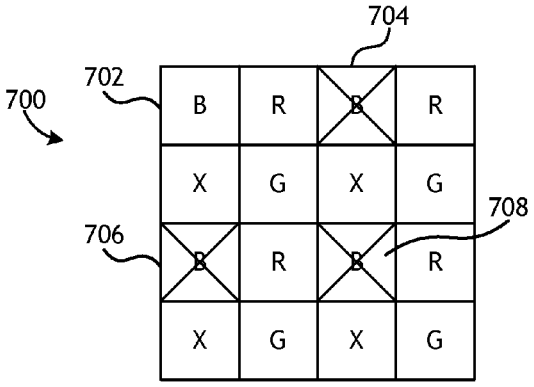
FIG. 7 is a conceptual diagram illustrating one embodiment of a method for power control in an OLED display device.
Figure 8:
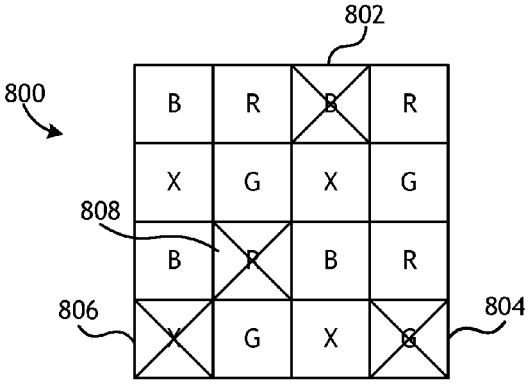
FIG. 8 is a conceptual diagram illustrating one embodiment of a method for power control in an OLED display device.

The portion of the display matrix 500 is reproduced in FIGS. 6-8 for illustrative purposes. One of ordinary skill in the art will recognize that a typical display device will include thousands, millions, or even billions of pixels, thus the embodiments of FIGS. 5-8 may be scalable, depending upon the size of the OLED display device. In order to reduce power, certain OLED devices 504 may be deactivated to reduce power consumption. In an alternative embodiment, the intensity of certain OLED devices may be throttled to reduce power consumption.

FIG. 6 is a conceptual diagram illustrating one embodiment of a method 600 for power control in an OLED display device. In the embodiment of FIG. 6, the resolution of the display device may be reduced, thereby reducing power consumption. For example, as shown in FIG. 6, all OLED devices may be deactivated, except for a blue LED 602 in a first pixel, a red LED 604 in a second diode, a green LED 606 in a third pixel, and another red diode 608 in a fourth pixel. Thus the resolution may be reduced by a 4:1 ratio, and the power consumption may be reduced accordingly.

FIG. 7 is a conceptual diagram illustrating one embodiment of a method 700 for power control in an OLED display device. In the embodiment of FIG. 7, a blue LED 702 in a first pixel may remain active, but the blue diode 704-708 in the remaining three pixels is deactivated. The blue LED is typically the highest power consumer, thus, deactivating three of the four blue diodes may significantly reduce power consumption. Such an embodiment would be suitable for use cases in which a slight tint to a white background is acceptable, for example in e-reader or word processing applications.

FIG. 8 is a conceptual diagram illustrating one embodiment of a method 800 for power control in an OLED display device. In the embodiment of FIG. 8, all of the LEDs in the first pixel remain active. A blue LED 802 in the second pixel is deactivated, a green LED 804 in the third pixel is deactivated, and one or both of the red LEDs 806-808 in the fourth pixel is deactivated. Thus, the overall balance of color is maintained, while reducing power consumption by up to one quarter (¼) of the total power consumption from the matrix.

While certain specific power reduction layouts or methods have been described with relation to the embodiments of FIGS. 6-8, one of ordinary skill may recognize additional or alternative embodiments which may be suitable for use according to the present embodiments.

Figure 9:
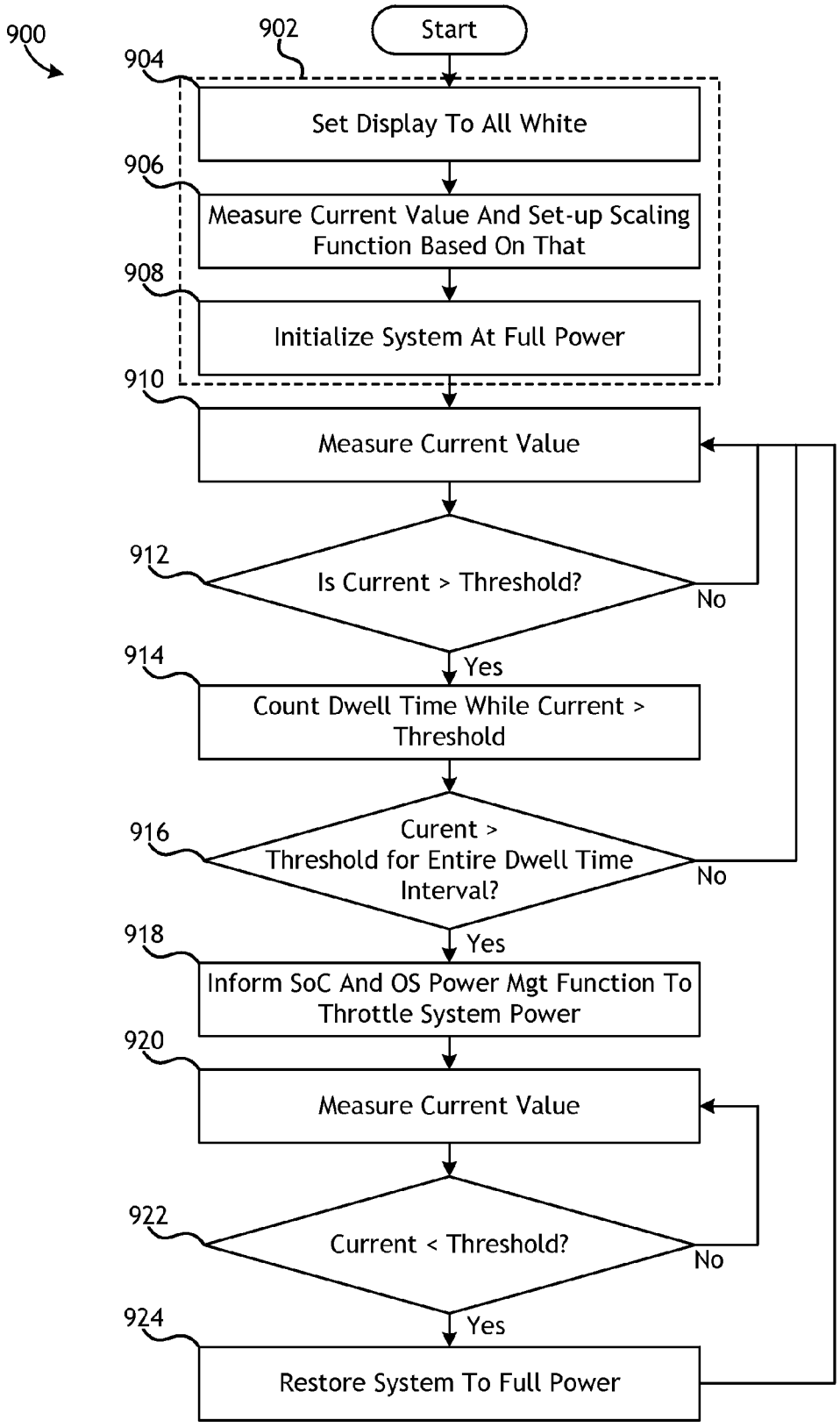
FIG. 9 is a schematic flowchart diagram illustrating one embodiment of a method for power control in an OLED display device.

FIG. 9 is a schematic flowchart diagram illustrating one embodiment of a method 900 for power control in an OLED display device. In an embodiment, the method 900 starts with a one-time initialization and calibration process 902 as described by blocks 904-908. The method 900 may including setting the display to all white as shown at block 904. This may be done at system startup, for example. At block 906, the method 900 may include measuring a current value, for example at the current sensor resistor 306, and setting a scaling function based on the current draw at full white. Then, at block 908, the system may be initialized at full power. At block 910, the current may be measured and checked against a threshold value as shown at block 912. If the current draw is over the threshold, then a timer may be set. As shown at block 914. If at block 916, the current was over the threshold for the entire dwell time as established by the timer, then the controller 310 may send the power state request to the SoC and OS power management function to throttle the system power as shown at block 918. The system power may be throttled either by changing the power state at the system power control 312, or by setting a pixel sub-sampling scheme as illustrated in FIGS. 6-8. The current draw may be consistently measured as shown at block 920, and if the current drops below the threshold as shown at block 922, the system may be restored to full power as shown at block 924, where the process of monitoring current and reducing power may be repeated as needed.

In certain embodiments, additional criteria may be used to determine when the system power is throttled at the power system control 312, or whether a subsampling method is employed, or both. For example, the decision may be based upon a selection of active applications or software processes running on the system. Alternatively, the decision may be determined in response to the systems processor idle state, or other criteria recognizable by one of ordinary skill in the art.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A method, comprising:

monitoring a level of current draw from an Organic Light Emitting Diode (OLED) display device;

comparing the level of current draw to a threshold value; and throttling system power consumption in response to the level of current draw exceeding the threshold value, wherein throttling the system power comprises subsampling one or more OLEDs in the OLED display device.

2. The method of claim 1, calibrating the threshold value upon system initialization.

3. The method of claim 2, wherein calibrating the threshold value further comprises causing the OLED display device to display white on each pixel.

4. The method of claim 3, wherein calibrating the threshold value further comprises measuring the level of current draw while the OLED display device is displaying white on each pixel.

5. The method of claim 4, wherein calibrating the threshold value further comprises setting a scaling function to set thresholds at predetermined ratios of the full power when the OLED display device is displaying white on each pixel.

6. The method of claim 1, further comprising measuring a current value at a current sensor disposed between a power source and an OLED matrix.

7. The method of claim 1, further comprising measuring a time interval in which the level of current draw exceeds the threshold.

8. The method of claim 7, further comprising determining whether the level of current draw has exceeded the threshold during the time interval.

9. The method of claim 1, wherein throttling the system power further comprises causing the system power control to enter a power-save mode.

10. The method of claim 1, wherein the step of subsampling one or more OLEDs in the OLED display device comprises disabling a portion of blue LEDs in the OLED display device.

11. A system, comprising:

a current sensor device configured to monitor a level of current draw from an Organic Light Emitting Diode (OLED) display device;

a controller coupled to the current sensor device, the controller configured to:

compare the level of current draw to a threshold value; and throttle system power consumption in response to the level of current draw exceeding the threshold value, wherein the system power consumption is throttled by subsampling one or more OLEDs in the OLED display device.

12. The system of claim 11, wherein the controller is further configured to calibrate the threshold value upon system initialization.

13. The system of claim 12, wherein the controller is configured to calibrate the threshold value by causing the OLED display device to display white on each pixel.

14. The system of claim 13, wherein calibrating the threshold value further comprises measuring the level of current draw while the OLED display device is displaying white on each pixel.

15. The system of claim 14, wherein calibrating the threshold value further comprises setting a scaling function to set thresholds at predetermined ratios of the full power when the OLED display device is displaying white on each pixel.

16. The system of claim 11, wherein the current sensor device is disposed between a power source and an OLED matrix of the OLED display device.

17. The system of claim 11, wherein the controller is further configured to measure a time interval in which the level of current draw exceeds the threshold.

18. The system of claim 17, wherein the controller is further configured to determine whether the level of current draw has exceeded the threshold during the time interval.

19. The system of claim 11, wherein throttling the system power further comprises causing a system power control to enter a power-save mode.

20. The apparatus of claim 11, wherein the controller is configured to subsample one or more OLEDs by disabling a portion of blue LEDs in the OLED display device.

* * * * *